United States Patent [19]

Hisaoka et al.

[11] Patent Number: 4,472,132

[45] Date of Patent: Sep. 18, 1984

[54] PULSE COMBUSTOR

[75] Inventors: Satoshi Hisaoka, Fujinomiya; Toshihiko Saito; Moriyoshi Sakamoto, both of Yokohama, all of Japan

[73] Assignee: Tokyo Shibaura Denki Kabushiki Kaisha, Japan

[21] Appl. No.: 379,946

[22] Filed: May 19, 1982

[30] Foreign Application Priority Data

May 20, 1981 [JP] Japan ..... 56-72788[U]

[51] Int. Cl.[3] ..... F24C 11/04

[52] U.S. Cl. ..... 431/1; 431/158

[58] Field of Search ..... 431/1, 158; 60/39.77, 60/39.81; 122/24

[56] References Cited

U.S. PATENT DOCUMENTS

| | | | |
|---|---|---|---|
| 2,647,365 | 8/1953 | Myers | 60/270.1 |
| 2,898,978 | 8/1959 | Kitchen et al. | 431/1 |
| 3,005,485 | 10/1961 | Salgo et al. | 431/1 |
| 3,267,985 | 8/1966 | Kitchen et al. | 431/1 |
| 3,486,331 | 12/1969 | Brown | 60/39.77 |
| 3,503,383 | 3/1970 | Meyer | 431/1 |

FOREIGN PATENT DOCUMENTS

| | | |
|---|---|---|
| 972555 | 8/1959 | Fed. Rep. of Germany . |
| 72704 | 5/1980 | Japan . |
| 102804 | 8/1980 | Japan . |
| 995217 | 6/1965 | United Kingdom . |

OTHER PUBLICATIONS

J. C. Griffiths, R. W. Niedzwiecki, American Gas Association Laboratories Research Bulletin 101, p. 16, (1965).

*Primary Examiner*—Lee E. Barrett

*Attorney, Agent, or Firm*—Cushman, Darby & Cushman

[57] ABSTRACT

A pulse combustor comprises a throttle plate provided in a cylindrical body for dividing the interior of the body into a combustion chamber and a mixture chamber and having a throttle hole, gas suction holes communicating with the combustion chamber, air suction holes communicating with the combustion chamber, igniting plug provided in the combustion chamber for explosing and burning the mixture gas of the air and the fuel gas therein, and valve plate provided in the mixture chamber for shutting off the communication of the gas suction holes and air suction holes with the mixture chamber when the pressure in the mixture chamber becomes positive as the mixture gas is exploded and burnt and enabling the communication when the pressure in the mixture chamber becomes negative.

7 Claims, 4 Drawing Figures

PULSE COMBUSTOR

BACKGROUND OF THE INVENTION

The present invention relates to a pulse combustor which has a gas mixture chamber and a combustion chamber.

In a conventional pulse combustor, a body 10 is, as shown in FIG. 1, divided by a flame trap 11 provided in the intermediate with a number of through holes into a combustion chamber 12 and a mixture chamber 13. In the mixture chamber 13 are provided a gas suction valve 14 at the base for supplying fuel gas, and a gas manifold 16 having a plurality of gas outlets 15 formed at the upper peripheral edge. Further, an air suction valve 17 is provided around the gas manifold 16. In combustion, fuel fed through the gas manifold 16 and air sucked through the air suction valve 17 are mixed in the mixture chamber 13, and the mixture gas thus formed is supplied through the flame trap 11 to the combustion chamber 12, and is pulse burnt in the chamber.

The flame trap 11 is constructed to prevent the flame from being introduced into the mixture chamber 13, but when the flame trap 11 is partly damaged, a reverse flame occurs with the result that a flame is formed at the gas outlets 15. Consequently, the pulse combustion is transformed into a continuous combustion, and hence the flame trap is excessively heated. Thus, the manifold 16 might be damaged due to the radiation heat from the overheated flame trap. Further, the flame trap of this utility is complicated in construction resulting in the expensive combustor as its drawbacks.

SUMMARY OF THE INVENTION

It is an object of the present invention to provide a pulse combustor which does not employ an expensive member such as, a flame trap, but can perform stable pulse combustion.

DETAILED DESCRIPTION OF THE PREFERRED EMBODIMENT

The present invention will now be described in more detail with reference to the accompanying drawings.

Figure 1:
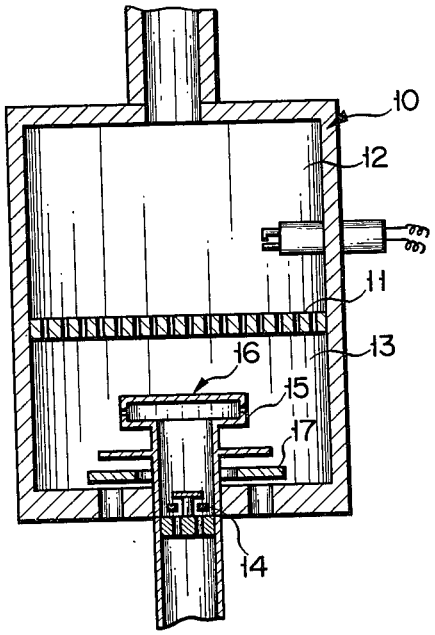
FIG. 1 PRIOR ART
FIG. 1 is a sectional view showing a conventional pulse combustor.
Figure 2:
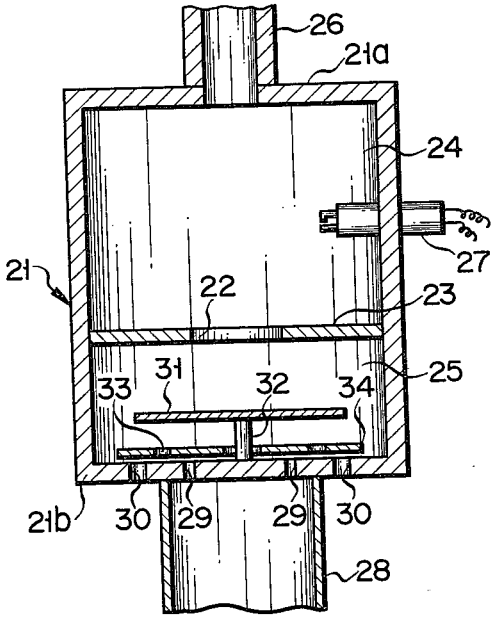
FIG. 2 is a sectional view showing a pulse combustor according to one preferred embodiment of the present invention.

In FIG. 2, reference numeral 21 indicates a cylindrical body closed at the upper and lower ends respectively with upper and lower walls **21*a* and 21*b* and having an inner diameter of 75 mm, for example. In the body 21, near the lower wall 21*b* is provided a throttle plate 23 formed with a circular throttle hole 22 at the center for dividing the interior into an upper combustion chamber 24 and a lower mixture chamber 25. For example, the combustion chamber 24 has a height of 130 mm, and the mixture chamber 25 a height of 10 mm. At generally center of the upper wall 21*a* of the body 21 is provided an exhaust tube 26 having an inner diameter of 20 mm, for example, which communicates with the combustion chamber 24. In the combustion chamber 24 is provided an ignition plug 27** to which a high voltage is applied from a power source (not shown) at its starting time.

At the lower wall **21*b* of the body 21 are formed a number of gas suction holes 29 arranged at a predetermined interval in a peripheral direction on the circular line around the center of the lower wall 21*b* as a center. At the lower wall 21*b* are further formed with a number of air suction holes 30 arranged at a predetermined interval in a peripheral direction on the circular line outside the gas suction holes 29. To the outer surface of the lower wall 21*b* is connected a gas supply tube 28, one end of which is mounted to communicate with the gas suction holes 29 so that combustion gas such as natural gas and cool gas is supplied into the body 21 through the gas supply tube 28 and gas suction holes 29. On the inner surface of the lower wall 21*b* is projected a mounting shaft 32 at the center of the wall 21*b*. At the extended end of the shaft 32 is coaxially mounted a disk-shaped valve stopper 31 to confront the inner surface of the lower wall 21*b* at a predetermined interval. In this particular instance, they are spaced approximately 0.5 to 1.0 mm across from each other. On the shaft 32 is provided a valve plate 34 of a disk shape in such a manner that the shaft 32 is loosely inserted into the circular hole formed at the center of the valve plate 34. Thus, the valve plate 34 is slidably movable along the mounting shaft 32 between the valve stopper 31 and the inner surface of the lower wall 21*b*. At the valve plate 34 are formed a number of through holes 33 arranged at a predetermined interval on a circular line around the center of the valve plate 34 as a center between the gas suction holes 29 and the air suction holes 30 to confront the valve stopper 31**.

The opening area A of the throttle opening 22 of the throttle plate 23 should be larger than the area B, the sum of the cross sections of the gas suction holes 29 and the air suction holes 30, but smaller than the sectional area C of the combustion chamber 24, preferably smaller than the 90% of the sectional area C to effectively maintain pulse combustion.

The operation of the pulse combustor thus constructed will now be described.

Air is fed by a blower (not shown) from the air suction holes 30 formed at the lower wall **21*b* of the body 21 into the mixture chamber 25, and fuel gas is also supplied from the gas suction holes 29 into the mixture chamber 25. At this time the valve plate 34 is lifted by the pressure of these air and fuel gas, and the air and the fuel gas can thus flow into the mixture chamber 25. The air and the fuel collide first with the valve plate 34 forming a number of vortex whirls and then they pump into the throttle plate 23 in the mixture chamber 25, and further flow through the throttle hole 22 into the combustion chamber 24. The ignition plug 27 is ignited at this time, so that the air fuel mixture is burnt and exploded. When the air fuel mixture is thus burnt and exploded, the pressure of the combustion chamber 24, and the upper portion of the valve plate 34 of the mixture chamber 25 become positive due to the expansion of the gas. As a result, the valve plate 34 is depressed to the bottom surface of the mixture chamber 25 and accordingly the inner surface of the lower wall 21*b* of the body 21, thereby preventing the flow of the gas and air through the gas suction holes 29 and the air suction holes 30. The combustion gas in the combustion chamber 24 is exhausted under high pressure from the exhaust tube 26, and as a result that the pressure in the combustion chamber 24 and the mixture chamber 25 thus becomes negative. Thus, the valve plate 34 is sucked to the position of the valve retainer 31, the gas suction holes 29 and the air suction holes 30 are thus opened, and the fuel gas and the air once again flow into the mixture chamber 25. The flowing fuel gas and the air thus collide with the throttle plate 23 and establish a vortex flow in the mixture chamber 25. The resultant mixture flows into the combustion chamber 24. A voltage is applied to the ignition plug 27 for the first number of pulsations, but once the inner wall of the combustion chamber 24** reaches a sufficiently high temperature, the mixture gas ignites and explodes on its own. Thus, the cycle of suction, ignition explosion, expansion, exhaust and suction repeates in this manner in a pulse combustion.

Figure 3A:
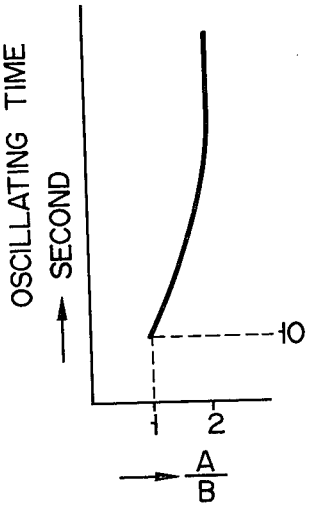
FIGS. 3A and 3B are diagrams showing the relationship between the throttle holes of the throttle plate in the sectional area and the oscillating duration time.
Figure 3B:
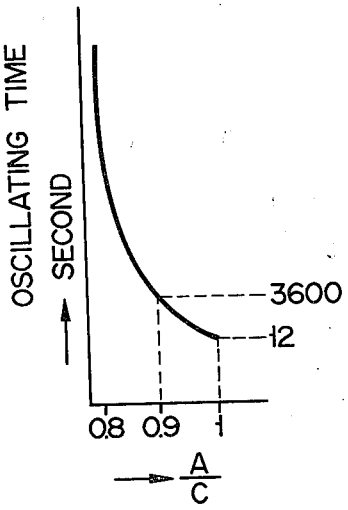

In the pulse combustor thus constructed, the oscillating duration time can be varied as shown in FIGS. 3A and 3B by varying the ratio of the opening area A of the throttle hole 22 to the flow passage area B and the ratio of the opening area A to the lateral sectional area C.

It may be understood from FIGS. 3A and 3B that the oscillation duration time may be increased if the area A is selected to be nearly 2 times the area B and be nearly 0.8 time the area C. It should be noted here that indeed primary combustion takes place in the combustion chamber 24, yet part of the combustion gas backfires through the opening 22 into the mixture chamber 25 leading to a minor combustion over and around the valve stopper 31. This means that in the current invention the effective volume used for combustion expands beyond the combustion chamber 24 into the mixing chamber 25, helping reinforce durability of pulse combustion against external disturbances such as mechanical vibrations and undurations in gas and air supplies.

In FIG. 3A, the oscillation duration time is about 12 seconds if A/B equals 1.0, but it approaches infinity as A/B equals 2.0. In FIG. 3B, the oscillation duration times are about 10 seconds and 3,600 seconds upon A/C of 1.0 and 0.9, respectively.

In the embodiment described above, the throttle plate having one throttle hole is used. However, a throttle plate having a plurality of throttle holes may also be used. The air suction holes and the fuel gas suction holes may not always be arranged on the circular line, and the former may be arranged at the inner peripheral side of the latter. In the embodiment described, the air suction holes and the fuel gas suction holes are commonly formed at one valve plate. However, two valve plates which are independently driven to correspond to the air suction holes and fuel gas suction holes may also be employed.

What we claim is:

1. A pulse combustor comprising:

a cylindrical body defining an interior space;

a throttle plate provided in said body for dividing the interior space of said body into a combustion chamber and a mixture chamber and having means defining at least one throttle hole for communicating said combustion and mixture chambers to permit a combustible mixture of fuel gas and air to flow from said mixture chamber to said combustion chamber;

at least one gas suction hole communicating with said mixture chamber, fuel gas being supplied through said suction hole into said mixture chamber;

at least one air suction hole formed at said body and communicating with said mixture chamber, air being supplied through said suction hole into said mixture chamber;

igniting means provided in said combustion chamber for triggering explosive combustion of the mixture gas of the air and the fuel gas therein;

valve stopper means fixed in said mixture chamber and separated from said at least one gas and air suction holes and having an outer periphery extending beyond the periphery of said at least one throttle hole for preventing said fuel gas and air from flowing directly into said at least one throttle hole; and valve means provided in the mixture chamber between said valve stopper means and said at least one gas and air suction holes for shutting off the communication of said at least one gas suction hole and said at least one air suction hole with said mixture chamber upon movement to the first position by the pressure produced when the pressure in said mixture chamber becomes positive as the mixture gas is exploded and burnt and enabling the communication of said gas suction hole and said air suction hole with said mixture chamber upon movement to the second position by the pressure when the pressure in said mixture chamber becomes negative.

2. The pulse combustor according to claim 1, wherein a plurality of gas suction holes and a plurality of air suction holes are formed at said body.

3. The pulse combustor according to claim 2, wherein a plurality of gas suction holes are arranged along a first circular line, and a plurality of air suction holes are arranged along a second circular line concentrically with said first circular line.

4. The pulse combustor according to claim 3, wherein said valve means has a valve plate provided in said mixture chamber and capable of closing the gas suction holes and air suction holes.

5. The pulse combustor according to claim 4, wherein said valve means includes a supporting shaft projected at the center of the circular lines, and a valve retainer provided at the projected end of said supporting shaft, said valve plate has a hole, the supporting shaft is movably inserted into the hole of said valve plate, and said valve plate is reciprocatingly movable between the first position disposed at the gas suction hole and the air suction hole side and the second position disposed at the valve retainer side.

6. The pulse combustor according to claim 1, wherein the opening area of the throttle hole of said throttle plate is larger than the total flow passage area of the gas suction hole and the air suction hole and smaller than 90% of the lateral sectional area of said combustion chamber.

7. A pulse combustor comprising:

a cylindrical body;

a throttle plate provided in said body for dividing the interior of said body into a combustion chamber and a mixture chamber and having at least one throttle hole;

a plurality of gas suction holes in communication with said mixture chamber and arranged along a first circular line, fuel gas being supplied through said gas suction holes into said mixture chamber;

a plurality of air suction holes in communication with said mixture chamber and arranged along a second circular line, air being supplied through said air suction holes into said mixture chamber;

igniting means provided in said combustion chamber for triggering explosive combustion of the mixture gas of the air and the fuel gas therein; and a valve provided in the mixture chamber and including valve plate means for shutting off the communication of said gas suction holes and said air suction holes with said mixture chamber upon movement to the first position by the pressure produced when the pressure in said mixture chamber becomes positive as the mixture gas is exploded and burnt and enabling the communication of said gas suction holes and said air suction holes with said mixture chamber upon movement to the second position by the pressure when the pressure in said mixture chamber becomes negative, said valve plate means including a supporting shaft projected at the center of said first and second circular lines, and a valve retainer provided at the projected end of said supporting shaft, said valve plate means defining a hole, the supporting shaft being movably inserted into the hole of said valve plate means, said valve plate means being reciprocally movable between the first position disposed at the side of the gas suction holes and the air suction holes and the second position disposed at the valve retainer side, and wherein said valve plate means includes through holes disposed between the gas suction holes and the air suction holes.

* * * * *